US007075405B2

(12) United States Patent
Takehana et al.

(10) Patent No.: US 7,075,405 B2
(45) Date of Patent: Jul. 11, 2006

(54) MULTILAYER CHIP VARISTOR AND METHOD OF MANUFACTURING THE SAME

(75) Inventors: Makikazu Takehana, Nikahomachi (JP); Osamu Hirose, Nikahomachi (JP); Toshiaki Ochiai, Honjo (JP)

(73) Assignee: TDK Corporation, Tokyo (JP)

( * ) Notice: Subject to any disclaimer, the term of this patent is extended or adjusted under 35 U.S.C. 154(b) by 50 days.

(21) Appl. No.: 10/733,350

(22) Filed: Dec. 12, 2003

(65) Prior Publication Data

US 2004/0119579 A1 Jun. 24, 2004

(30) Foreign Application Priority Data

Dec. 17, 2002 (JP) ..... 2002-365269

(51) Int. Cl.
*H01C 7/10* (2006.01)

(52) U.S. Cl. ..... 338/21; 338/20

(58) Field of Classification Search ..... 338/20, 338/21

See application file for complete search history.

(56) References Cited

U.S. PATENT DOCUMENTS 4,290,041 A * 9/1981 Utsumi et al. ..... 338/21
5,075,665 A * 12/1991 Taira et al. ..... 338/21
6,232,867 B1 * 5/2001 Yoshida et al. ..... 338/21
2002/0109575 A1 * 8/2002 Jeong et al. ..... 338/21
2003/0043012 A1 * 3/2003 Shiraishi et al. ..... 338/21

FOREIGN PATENT DOCUMENTS

JP 05-006805 * 1/1993 ..... 338/21
JP A 6-349313 12/1994
JP A 8-031616 2/1996
JP A 10-070012 3/1998
JP A 2000-164406 6/2000
JP A 2001-122639 5/2001
JP A 2002-134306 5/2002

OTHER PUBLICATIONS

English machne translation to Nakamura above, 05-006805, (Jan. 1993).*

* cited by examiner

*Primary Examiner*—Tu Hoang
(74) *Attorney, Agent, or Firm*—Oliff & Berridge, PLC

(57) ABSTRACT

The multilayer chip varistor of the present invention includes a varistor body including a plurality of varistor layers and inner electrodes arranged to sandwich each of the varistor layers, terminal electrodes formed on each ends of the varistor body and connected to the inner electrodes, and glass layers formed between the varistor body and the terminal electrodes. In addition, a plated layers and are formed on the surface of the terminal electrodes.

6 Claims, 4 Drawing Sheets

COVERING RATE 5%

COVERING RATE 80%

PRIOR ART

MULTILAYER CHIP VARISTOR AND METHOD OF MANUFACTURING THE SAME

BACKGROUND OF THE INVENTION

1. Field of the Invention

The present invention relates to a multilayer chip varistor and a method of manufacturing the same.

2. Related Background Art

There is a known multilayer chip varistor including a varistor body obtained by sintering a stack of varistor layers and inner electrode, and terminal electrodes formed by applying conductive paste on end faces of the varistor body and thereafter drying and baking the applied paste.

The conductive paste that is frequently used for forming the terminal electrodes is obtained by mixing glass frit and organic vehicle with metal powder, a principal constituent, such as silver. The glass frit is mixed into the conductive paste for the purpose of improving adhesion properties of the varistor body and the terminal electrodes.

This type of multilayer chip varistor is mounted on a printed circuit board and the like typically in a method of so-called reflows soldering. In this method, the varistor is put on solder paste which has been applied to a conductor on the board in advance, and thereafter, the entire board is heated to a temperature of 200 degrees centigrade or higher to melt the solder so that the varistor is fixed to the board.

At this time, it is often the case where the terminal electrodes are plated with nickel and then further plated with solder, tin or the like in order to improve wettability of the terminal electrode to the solder during reflow soldering.

However, when the terminal electrodes are plated, a plating solution enters inside of the varistor body, and the plating solution which entered inside of the varistor body sometimes corrodes the varistor layers in the varistor body, in particular, a grain boundary of a varistor material that constructs the varistor layers. Since varistor characteristics of the multilayer chip varistor is considered to be effective at the grain boundary, this corrosion of the grain boundary causes a degradation of the varistor characteristics of the multilayer chip varistor such as a decrease in varistor voltage and the like. Such degradation of the varistor characteristics may be observed immediately after plating or after the varistor is mounted on the board by reflow soldering.

In order to prevent the degradation of the varistor characteristics due to entry of a plating solution, various measures have been taken in recent multilayer chip varistors. For example, multilayer chip varistors described in Japanese Patent Laid-Open Publication No. Heisei 8-31616 and Japanese Patent Laid-Open Publication No. Heisei 10-70012 are known. FIG. 6 is a cross sectional view showing a multilayer chip varistor same as those described in the above-mentioned publications. The multilayer chip varistor shown in FIG. 6 has a varistor body 10 having inner electrodes 11 and terminal electrodes 12 provided on ends of the varistor body 10. In addition, insulating protection layers 13 are formed in portions of the varistor body 10, where the terminal electrodes 12 are not formed. In this multilayer chip varistor, the insulating protection layers 13 play a role of preventing the plating solution entering inside the varistor body 10.

Further, a multilayer chip varistor described in Japanese Patent Laid-Open Publication No. 2000-164406 is also known as the one in which entry of a plating solution into the varistor body can be reduced. FIG. 7 is a cross sectional view showing the multilayer chip varistor described in the above-mentioned publication. The multilayer chip varistor shown in FIG. 7 includes a varistor body 10 having inner electrodes 11 and ground electrode layers 14 provided on the ends of the varistor body 10. In addition, a glass layer 15 and external electrode layers 16 are formed on the outer sides of the ground electrode layers 14. Further, a conductive material is diffused within the glass layer 15, and thereby continuity between the ground electrode layers 14 and the external electrode layers 16 is realized.

Furthermore, a multilayer chip varistor is described in Japanese Patent Laid-Open Publication No. 2002-134306, in which terminal electrodes are formed using conductive paste containing a predetermined amount of conductive glass frit or a larger amount of the same. In this multilayer chip varistor, a content of the glass frit within the terminal electrodes is larger than that in a conventional varistor to reduce voids in the terminal electrodes, preventing a plating solution from penetrating the terminal electrodes. In addition, the use of conductive glass frit containing tin oxide or antimony oxide prevents a reduction in wettability to solder which often occurs as the amount of glass frit increases.

Furthermore, conductive paste containing glass frit having a particular composition is described in Japanese Patent Laid-Open Publication No. Heisei 6-349313 and Japanese Patent Laid-Open Publication No. 2001-122639. Terminal electrodes of a multilayer type element formed by this conductive paste is excellent in resistance to a plating solution, and it is thus proved that these terminal electrodes can prevent degradation of characteristics of the element due to entry of the plating solution.

SUMMARY OF THE INVENTION

In the multilayer chip varistor shown in FIG. 6, it is possible for the insulating protection layers 13 to prevent entry of a plating solution from the surface of the varistor body 10. However, the plating solution can enter inside the varistor body 10 through voids in the terminal electrodes 12, since the terminal electrodes 12 are not formed sufficiently densely. Particularly, the plating solution often enters inside the body 10 from gaps between the varistor body 10 and the inner electrodes 11. This causes severe corrosion of the varistor body 10 by the plating solution, further degrading the varistor characteristics.

Moreover, in the multilayer chip varistor shown in FIG. 6, the insulating protection layers 13 are formed by putting the varistor body 10 into silicon oxide powder and baking the same. Therefore, there has been a disadvantage of an increase in the number of steps in manufacturing the multilayer chip varistor.

Meanwhile, in the multilayer chip varistor shown in FIG. 7, not only the varistor body 10 but also the ground electrodes 14 are covered with the glass layer 15, and thus a plating solution hardly enters inside the varistor body 10. However, since the glass layer 15 has low conductivity, continuity between the ground electrode layers 14 and the terminal electrode layer 16 becomes insufficient, and thereby a value of resistance of the terminal electrodes as a whole tends to increase. In addition, there has been a problem that the step for forming the glass layer 15 increases the number of steps in manufacturing the multilayer chip varistor.

Moreover, in the multilayer chip varistor described in Japanese Patent Laid-Open Publication No. 2002-134306, electric conductivity of the glass frit which is contained in the conductive paste is five to six orders of magnitude lower than that of silver that normally serves as an electrode material. Thus, when the content of the glass frit is about an amount which does not cause degradation of resistance to plating solution, continuity between the ground electrode layers and the terminal electrode layers often becomes insufficient.

Yet further, in the conductive paste described in Japanese Patent Laid-Open Publication No. Heisei 6-349313 and Japanese Patent Laid-Open Publication No. 2001-122639, the glass frit itself has high resistance to a plate solution. However, it is difficult to form terminal electrodes densely. Therefore, the multilayer type element having the terminal electrodes formed by this conductive paste tends to be susceptible to entry of a plating solution thereinto.

The present invention was accomplished in the light of the foregoing circumstances. It is an object of the present invention to provide a multilayer chip varistor in which degradation of varistor characteristics is small even when surfaces of terminal electrodes are further plated, and a manufacturing method of the same.

In order to achieve the above object, the present invention provides a multiplayer chip varistor including a varistor body having a plurality of varistor layers and inner electrodes arranged to sandwich each of the varistor layers, terminal electrodes formed on ends of the varistor body and connected to the inner electrodes, and a glass layer formed between the varistor body and the terminal electrode.

The multilayer chip varistor having the above construction has the glass layers between the varistor body and the terminal electrodes. Therefore, when the surfaces of the terminal electrodes are further plated and a plating solution penetrates therethrough, the glass layers prevent the plating solution from entering inside the body. As a result, the multilayer chip varistor after plating has extremely small degradation of the varistor characteristics in comparison with the varistor before plating.

In the above mentioned multilayer chip varistor, it is preferred that, in a cross section taken along a line passing through the center of the terminal electrode in a width direction thereof, the glass layer be formed to cover not less than 10% of the total length of an area which is covered with the terminal electrode, in the varistor body. Accordingly, entry of the plating solution into the varistor body can be reduced more effectively. From the similar viewpoint, it is preferred that the glass layer have a thickness of 0.1 μm or larger.

More specifically, it is preferred that the terminal electrode of the above-mentioned multilayer chip varistor be formed by baking conductive paste containing a glass material, and that the glass layers be formed by the glass material melting from the conductive paste while baking the conductive paste.

In this case, it is not required to conduct a separate step for forming the glass layers like the aforementioned prior art. Thus, manufacturing process for the multilayer chip varistor can be simplified.

It is preferred that the conductive paste used hereinabove contain metal and the glass material, and that the content of the glass material be between 2 and 15 wt % with respect to an entire mass of the metal and the glass material. With this composition of the conductive paste, the glass material can be melted from the conductive material more easily.

Further, in the multilayer chip varistor, it is more preferred that the terminal electrode contain the glass material and silver or an alloy whose principal component is silver. In addition, it is more preferred that the inner electrodes contain palladium, platinum or an alloy whose principal components are palladium and platinum.

Still further, in the multilayer chip varistor of the present invention, it is more preferred that the inner electrodes protrude from the varistor body into the terminal electrode, and at least root portions of these inner electrodes protruding into the terminal electrodes be covered with the glass layer.

When the multilayer chip varistor has this kind of construction, adhesion status of the inner electrodes and the terminal electrodes is improved and thus a good contact state of both electrodes is realized. Additionally, since the root portions of the inner electrodes are covered with glass layers, it is difficult for the plating solution to enter inside the varistor body.

Moreover, a manufacturing method of a multilayer chip varistor of the present invention is a method of manufacturing the multilayer chip varistor having the foregoing construction easily. This method includes the steps of forming a varistor body having a plurality of varistor layers and inner electrodes arranged to sandwich each of the varistor layers, applying conductive paste containing a glass material onto ends of the varistor body, and baking the applied conductive paste to form terminal electrodes and to form a glass layer between the varistor body and the terminal electrodes by melting the glass material contained in the conductive paste.

According to this manufacturing method, the glass layers can be easily formed between the varistor layers and the terminal electrodes. In the multilayer chip varistor thus obtained, even though the surfaces of the terminal electrodes are further plated, the glass layers prevent entry of a plating solution into the varistor body. As a result, degradation of varistor characteristics owing to plating becomes extremely small.

In this manufacturing method, it is preferred that, in a cross section taken along a line passing through the center of the terminal electrode in a width direction thereof, each of the glass layers be formed to cover not less than 10% of the total length of an area which is covered with the terminal electrode, in the varistor body. It is also preferred that each of the glass layers be formed to have a thickness of 0.1 μm or larger. Accordingly, entry of the plating solution into the varistor body during plating process is prevented more effectively.

Moreover, it is preferred that the conductive paste be baked at a temperature that is at least 70 degrees centigrade higher than a softening point of the glass material contained in the paste. It is more preferable that the conductive paste is baked at 700 degrees centigrade or higher. When the conductive paste is baked at above-described temperature, the glass material is melted from the conductive paste even more easily, and thus easy formation of the glass layers which satisfy the aforementioned conditions becomes feasible.

DESCRIPTION OF THE PREFERRED EMBODIMENTS

Figure 1:
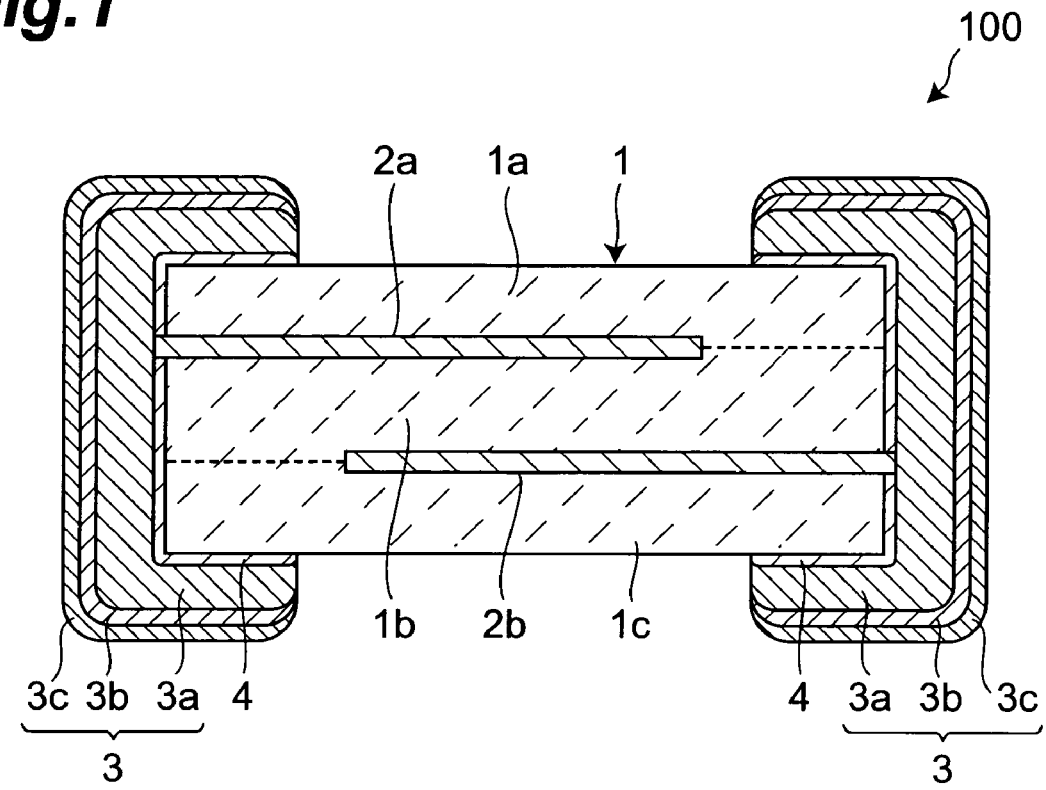
FIG. 1 is a cross sectional view showing a multilayer chip varistor according to a preferred embodiment.

A preferred embodiment of the present invention is described in detail hereinbelow. Note that, in description of the drawings, the same constituents are denoted with the same reference numerals and duplicated description will be omitted. Further, for convenience for showing in the drawing, dimension ratios in the drawings are not limited to those shown and do not necessarily match those in description. Further, positional relationships such as vertical and lateral directions are based on those in the drawings unless otherwise specified.

Figure 2:
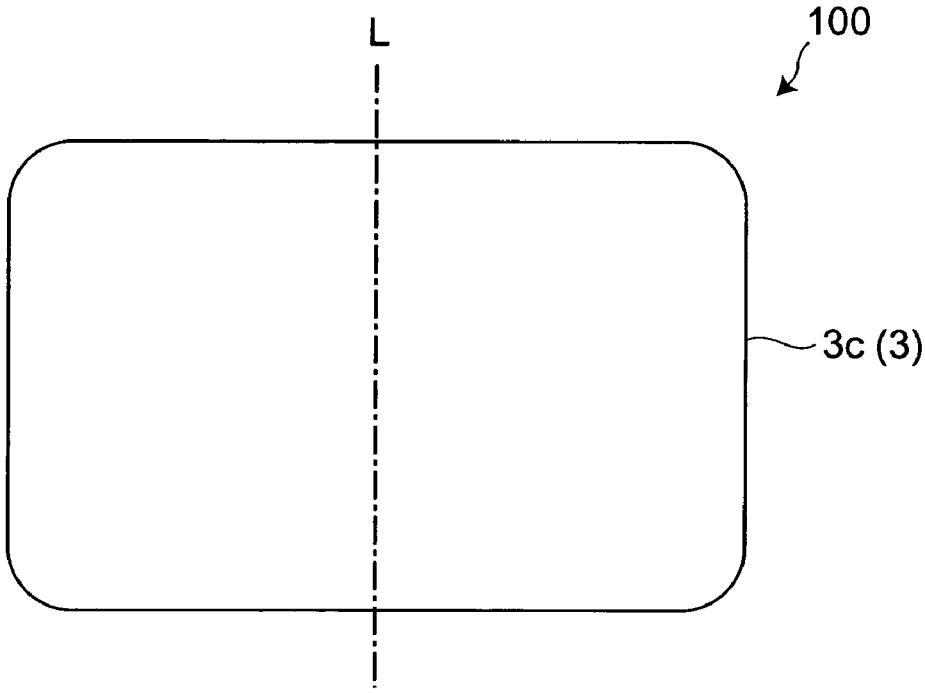
FIG. 2 is a side view showing the multilayer chip varistor 100.

First of all, the multilayer chip varistor according to a preferred embodiment is described with reference to FIGS. 1 and 2. FIG. 1 is a cross sectional view of the multilayer chip varistor according to the preferred embodiment, and FIG. 2 is a side view showing the multilayer chip varistor 100. The chip varistor 100 has a varistor body 1 and outer terminals 3 provided on edges of the varistor body 1, and glass layers 4 are formed between the varistor body 1 and the outer terminals 3.

In this multilayer chip varistor 100, the varistor body 1 includes varistor layers 1*a*, 1*b* and 1*c* and inner electrodes 2*a* and 2*b* arranged to sandwich the varistor layer 1*b*. In addition, each of the outer terminals 3 has terminal electrode 3*a* and plated layers 3*b* and 3*c* in this order. In addition, the inner electrodes 2*a* and 2*b* are formed (drawn out) so that one ends thereof are exposed out from the opposing end faces of the varistor body 1 on different sides and connected to the terminal electrodes 3*a*, respectively.

Any layers can be applied to the varistor layers 1*a*, 1*b* and 1*c*, without particular limitation as long as those layers are made of a varistor material which realizes varistor characteristics. To be more specific, a preferred example of the varistor layer includes a layer obtained by compounding a principal component of ZnO with a subcomponent such as rare-earth elements, Pr for example, and Bi, trace additive such as Al, and the like.

The inner electrodes 2*a* and 2*b* are exemplified by those made of a metal simple substance of Pt, Pd, Ag or the like, an alloy thereof or compound thereof. A metal simple substance of Pd or Pt, an Ag—Pd alloy or Ag—Pt alloy is preferred.

The terminal electrodes 3*a* are exemplified by those made of an electrode material similar to the aforementioned inner electrode 2*a* and 2*b*. In particular, those made of a metal single substance of Ag or an Ag—Pd alloy are preferred. Moreover, it is preferred that the terminal electrodes 3*a* further contain a glass material such as glass frit in addition to the foregoing metals. When the terminal electrodes 3*a* contain glass frit, adhesion property of the terminal electrodes to the varistor body 1 improves.

The thickness of each of the terminal electrodes 3*a* is preferably 5 to 100 μm and more preferably 20 to 70 μm. This prevents the plate solution from penetrating through each of the terminal electrodes 3*a* itself when plating, and the synergistic effect with the glass layer 4 further reduces the plating solution entering inside the varistor body 1.

It is preferred that the inner electrodes 2*a* and 2*b* and terminal electrodes 3*a* be made of different types of metals, each having a crystal structure of face-centered cubic lattice, in order for later-described Kirkendall effect to improve joint performance of both electrodes. From this point of view, the terminal electrodes 3*a* preferably contain silver or an alloy whose principal component is silver, and more preferably, the inner electrodes 2*a* and 2*b* contain palladium or platinum, or an alloy containing the palladium and platinum as principal components.

Each of the plated layers 3*b* has a function of preventing dissolution of metallization of terminal electrodes 3*a* when the multilayer chip varistor 100 is mounted on a board and the like by reflow. The plated layers 3*b* is preferably layers made of Ni, formed by electroplating. In addition, the plated layer 3*c* has characteristics to improve solderability during the reflow, and is preferably made of a material such as solder and Sn which has a good affinity with solder.

The glass layers 4 are made of glass material and prevent the plating solution from entering inside the varistor body 1 when being plated. When the terminal electrodes 3*a* contain glass frit as described earlier, it is more preferred that glass frit contained in the conductive paste for forming the terminal electrodes 3*a* melt to form these glass layers 4 while forming the terminal electrodes 3*a*. In this case, it is not required to conduct separate step for forming the glass layers 4, thus simplifying the manufacturing process of the multilayer chip varistor 100.

The glass layers 4 are exemplified by layers made of $B_2O_3$—ZnO—$Al_2O_3$—SrO based glass, $B_2O_3$—$SiO_2$—ZnO based glass, $B_2O_3$—$SiO_2$—ZnO—$Al_2O_3$ based glass, $SiO_2$—BaO—$Li_2O$ based glass, $B_2O_3$—$SiO_2$—ZnO based glass, $B_2O_3$—$SiO_2$—$Na_2O$based glass, $B_2O_3$—$SiO_2$—ZnO—$Al_2O_3$—SrO based glass, and the like.

In the multilayer chip varistor 100, it is preferred that the glass layers 4 be formed to cover the edges of the varistor body 1 in a percentage described below. In this specification, the percentage that the glass layer 4 covers an end face of the varistor body 1 is referred to as "coverage", and the coverage is defined as described below. Specifically, in a cross section taken along a line passing through the center of the outer terminal 3 (terminal electrode 3*a*) in a width direction (cross section taken along the straight line L in FIG. 2) in the multilayer chip varistor 100, the coverage r (%) is defined as a value calculated by the following equation (1), $$r(\%)=(L2/L1)\times 100 \quad (1)$$

where L1 is the entire length of an area (end face) of the varistor body 1, covered by the terminal electrode 3*a*, and L2 is a length of an area (end face) of the varistor body 1 in which the glass layer 4 is formed.

In this specification, "a width direction of the outer terminal 3 (terminal electrode 3*a*)" is defined as a direction of outer terminal 3 (terminal electrode 3*a*) perpendicular to the stacking direction of the varistor body 1.

In the multilayer chip varistor 100, the coverage of the glass layer 4 is preferably 10% or more, and the coverage of 40% or more is further preferred. If the coverage is 40% or more, the degradation of the characteristics of the multilayer chip varistor after plating can be reduced to a level at which there are almost no influences on practical use of the multilayer chip varistor.

If the glass layers 4 are formed by the glass material melting from the conductive paste when forming the terminal electrodes 3*a*, a coverage of not less than 80% of the glass layer 4 may induce an improper amount of melting glass frit coming out of the boundary face of the terminal electrode 3*a* on the opposite side of the varistor body 1. Therefore, from this viewpoint, it is particularly preferred that the coverage be between 40 and 80%.

Further, it is preferred that each of the glass layer 4 have a thickness of 0.1 μm or larger, and a thickness of 0.4 to 1.5 μm is more preferred, and a thickness of 0.4 to 0.8 μm is further preferred. Note that, in this specification, the thickness of the glass layer 4 is defined as an average value of those obtained by observing a cross section cut along the line L in FIG. 2 and measuring five points of the thickness of the glass layer 4.

When the thickness of the glass layer 4 is 0.1 μm or larger, entry of the plating solution into the varistor body 1 can be suppressed more efficiently. On the other hand, when the thickness of the glass layer 4 is more than 1.5 μm, it may be difficult to form the plated layers 3*b* and 3*c* on the surface of the terminal electrode 3*a*.

Dimensions of the multilayer chip varistor 100 having the foregoing construction may be changed as appropriate, depending on uses. However, in general, a length thereof (in a right-left direction in FIG. 2) is 0.6 to 5.6 mm, a width thereof (in a right-left direction in FIG. 1) is 0.3 to 0.6 mm, and a thickness thereof (in a up-down direction in FIG. 1) is 0.3 to 1.9 mm. Alternatively, the multilayer chip varistor may have a construction of a multilayer chip varistor array in which a plurality of outer terminals 3 is arrayed perpendicularly on the same face of the board or the like.

Figure 3:
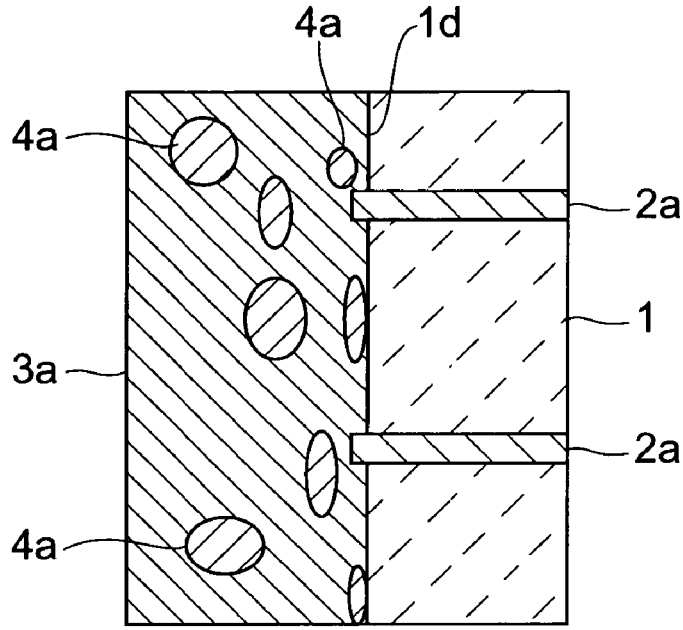
FIG. 3 a schematic cross sectional view showing an enlarged vicinity of a joint between a varistor body 1 and terminal electrode 3*a* of the multilayer chip varistor in which coverage of a glass layer is 5%.
Figure 4:
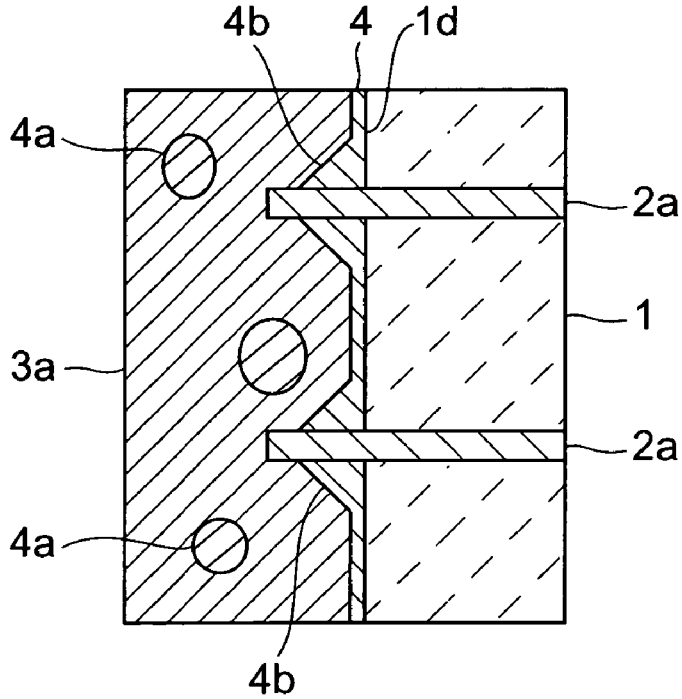
FIG. 4 is a schematic cross sectional view showing an enlarged vicinity of a joint between the varistor body 1 and the terminal electrode 3*a* of the multilayer chip varistor in which coverage of a glass layer is 100%.

Next, with reference to FIGS. 3 and 4, description will be provided regarding an example of a construction in a vicinity of a joint between the varistor body 1 and the terminal electrode 3*a* in the multilayer chip varistor 100 having the foregoing construction. FIG. 3 is a schematic cross sectional view showing an enlarged vicinity of the joint between the varistor body 1 and the terminal electrode 3*a* in the multilayer chip varistor in which the coverage of the glass layer 4 is 5%. FIG. 4 is a schematic cross sectional view showing an enlarged vicinity of the joint between the varistor body 1 and the terminal electrode 3*a* in the multilayer chip varistor in which the coverage of the glass layer 4 is 100%. Note that the multilayer chip varistors shown in FIGS. 3 and 4 and the multilayer chip varistor 100 mentioned earlier are different in that those in FIGS. 3 and 4 have a plurality of inner electrodes 2*a* or a plurality of inner electrodes 2*b*.

First of all, in the multilayer chip varistor in FIG. 3, the glass layer 4 is formed by melting glass frit 4*a* between the varistor body 1 and the terminal electrode 3*a*. Further, one end of each inner electrode 2*a* is exposed out from the edge of the varistor body 1. Here, the coverage of the glass layer 4 is 5%. Since the glass layer 4 is formed on the edge of the varistor body 1 in this way, the glass layer 4 prevents the plating solution from entering inside the varistor body 1 even though the plating solution penetrates though the terminal electrode 3*a* while plating.

In the multilayer chip varistor shown in FIG. 4, the glass layer 4 is formed by the melting grass frit 4*a* between the varistor body 1 and terminal electrode 3*a* to have the coverage of 100%. In addition, one end of each inner electrode 2*a* is protruding into the terminal electrode 3*a*, and the root portions of the protruding inner electrodes 2*a* are covered by glass layer 4*b*.

In this way, in the multilayer chip varistor in which the coverage of the glass layer 4 is 100%, the inner electrodes 2*a* are protruding into the terminal electrode 3*a*, and thus both electrodes join extremely well in addition, since peripheral areas of the root portions of the protruding inner electrodes 2*a* are covered with the glass layer 4*b*, entry of the plating solution from the joint between the terminal electrodes 3*a* and each of the inner electrodes 2*a* can be efficiently prevented. As a result, this multilayer chip varistor is significantly excellent in the effect of preventing entry of the plating solution.

Figure 5A:
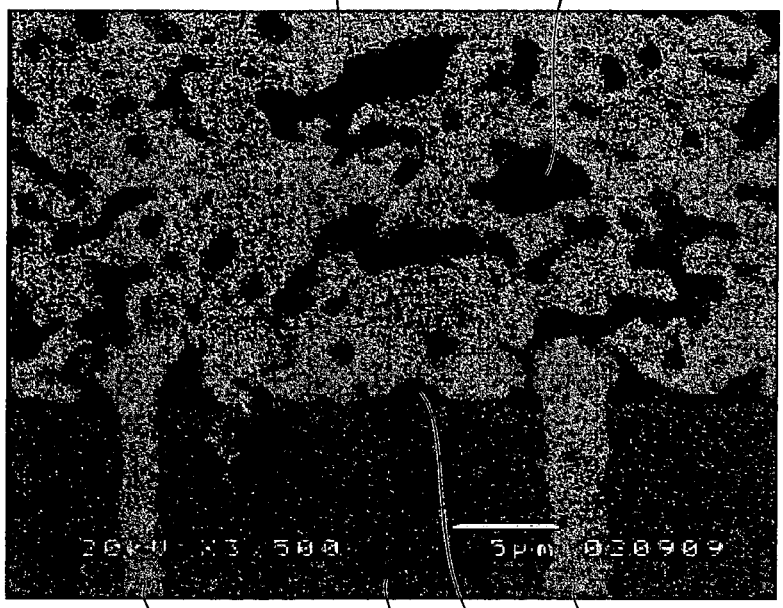
FIG. 5A is a photograph taken by a scanning electron microscope, showing the vicinity of the joint between the varistor body 1 and the terminal electrode 3*a* of the multilayer chip varistor in which the coverage of the glass layer 4 is 5%.
Figure 5B:
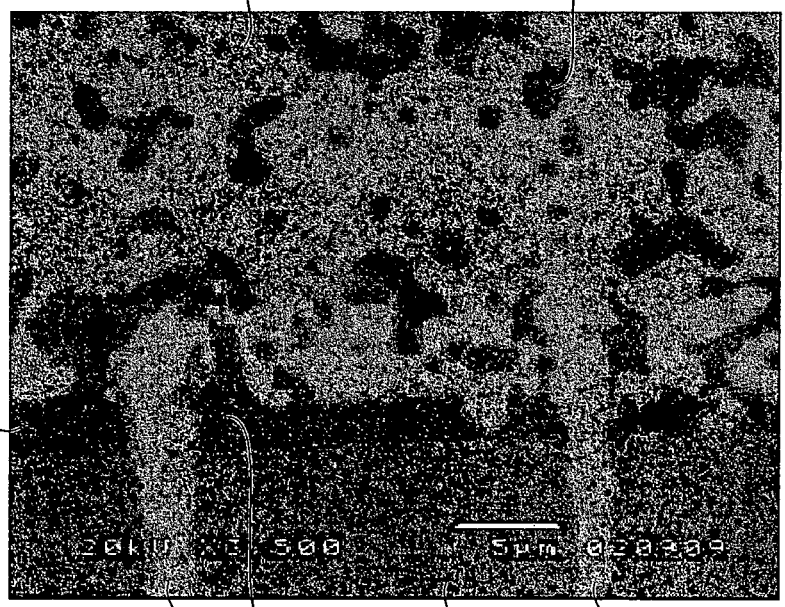
FIG. 5B is a photograph taken by a scanning electron microscope, showing the vicinity of the joint between the varistor body 1 and the terminal electrode 3*a* of the multilayer chip varistor in which the coverage of the glass layer 4 is 80%.
Figure 6:
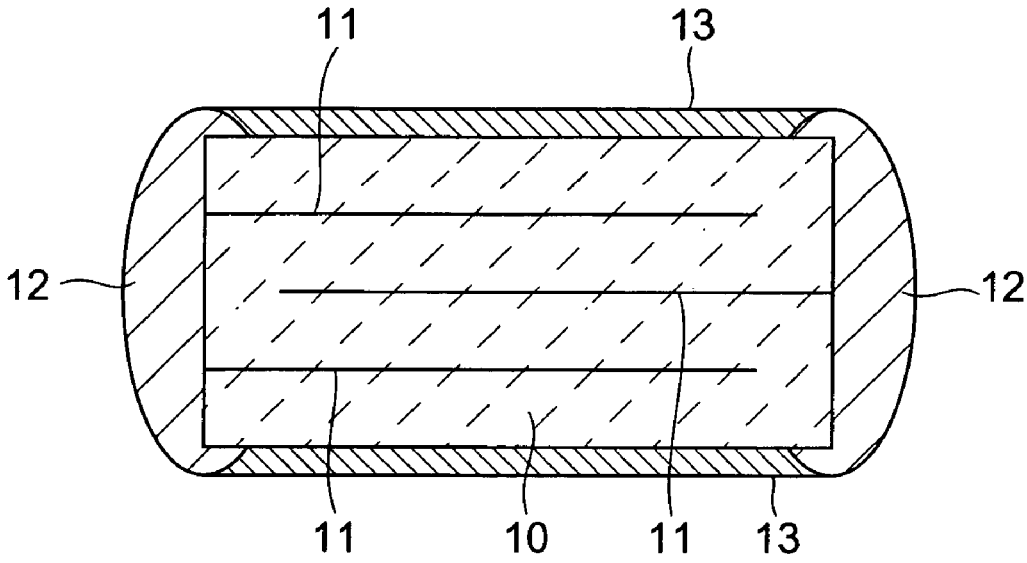
FIG. 6 is a cross sectional view showing a conventional multilayer chip varistor.
Figure 7:
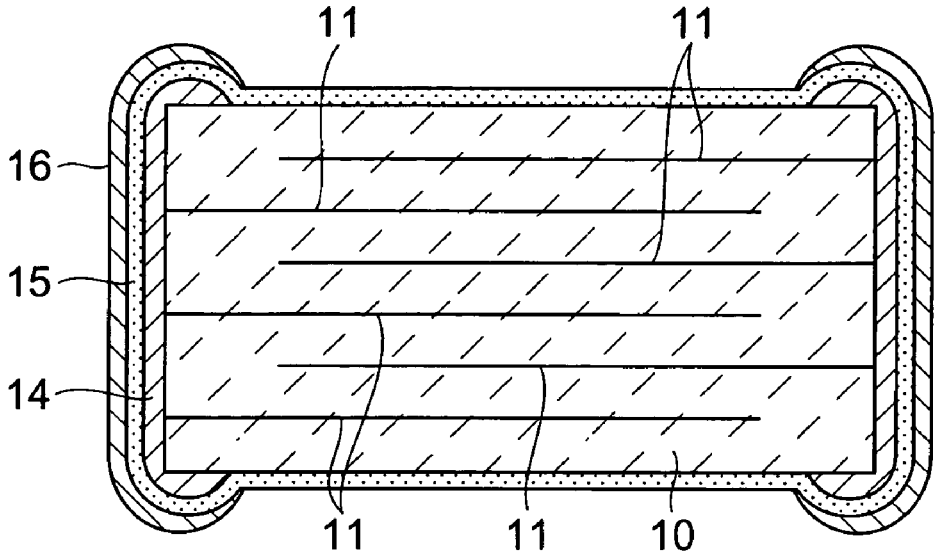
PRIOR ART Fig.7
FIG. 7 is a cross sectional view showing another conventional multilayer chip varistor.

Next, an example of each area shown in FIGS. 3 and 4 will be specifically described with reference to photographs shown in FIGS. 5A and 5B taken by a scanning electron microscope. FIG. 5A is a photograph taken by a scanning electron microscope, showing a vicinity of the joint between the varistor body 1 and the terminal electrode 3*a* in the multilayer chip varistor in which the coverage of the glass layer is 5%. FIG. 5B is a photograph taken by a scanning electron microscope, showing a vicinity of the joint between the varistor body 1 and the terminal electrode 3*a* in the multilayer chip varistor in which the coverage of the glass layer is 80%.

As shown in FIG. 5A, in the multilayer chip varistor in which the coverage of the glass layer is 5%, the glass layer 4 is formed by melting glass frit 4*a* in a boundary of the varistor body 1 and the terminal electrode 3*a*, covering a part of the varistor body 1. Further, in FIG. 5A, one end of the inner electrodes 2*a* exposed out from the end face of the varistor body 1 are recognizable.

In the multilayer chip varistor shown in FIG. 5B, the glass layer 4 formed by the melting glass frit 4*a* covers a major portion of the varistor body 1. The glass layer 4 in this case is formed to have a larger thickness than that shown in FIG. 5A. In addition, it can be recognized that the inner electrodes 2*a* are protruding into the terminal electrode 3*a*, and further, the root portions of terminal electrodes 2*a* are covered with the glass layer 4*b*.

Next, a manufacturing method of the multilayer chip varistor 100 having the foregoing construction will be described. First of all, a green chip, which is the varistor body 1 before sintering, is formed in a print method, a sheet method or the like.

When making a green chip in the former method, which is the print method, paste for forming a varistor layer and conductive paste for forming inner electrode are prepared. The paste for a varistor layer may be organic paste obtained by compounding a varistor material and an organic vehicle, and water-based paste obtained by compounding the varistor material and water-based solvent.

For the varistor material, a material which exhibits the varistor characteristics after baking can be selected and used, and Zn oxide such as ZnO, and Zn compound which forms Zn oxide by baking are preferred. The Zn compound which forms Zn oxide by baking is, for example, carbonate, nitrate, oxalate, organometallic compounds and the like of Zn. The Zn oxide and Zn compound maybe combined as appropriate for use.

In addition to the above-mentioned Zn oxide and Zn compound, a subcomponent such as rare-earth elements, praseodymium (Pr) for example, and Bi, trace additive such as Al and the like may be added to the varistor material. It is preferred that the varistor material having the aforementioned composition have a mean particle size of about 0.3 to 2 μm.

The organic vehicle to be compounded with the organic paste is exemplified by a vehicle obtained by dissolving binder in an organic solvent. For this binder, the one generally used for manufacturing the organic vehicle can be selected as appropriate and used, and ethyl cellulose, polyvinyl butyral and the like may be used. The organic solvent is exemplified by terpineol, butylcarbitol, acetone, toluene and the like.

Further, the water-based solvent used for the water-based paste may be exemplified by one obtained by dispersing water soluble binder or the like in water. For the water soluble binder, polyvinyl alcohol, cellulose, water soluble acrylic resin, emulsion and the like can be selected as appropriate and used.

The conductive paste for the inner electrodes includes one prepared by kneading the aforementioned organic vehicle and a conductive material for making the inner electrodes or one, which will be the conductive material after baking, _such as oxide, organometallic compound, and resinate. It is preferred that the conductive material for making the inner electrodes be the metal simple substance of Pd or Pt, an Ag—Pd alloy, or an Ag—Pt alloy.

In a case of using the organic vehicle in preparing the foregoing paste, the content of the binder is preferably 1 to 5 wt % with respect to the entire weight of the organic vehicle. It is also preferred that the content of the organic solvent be 10 to 50 wt % with respect to the entire weight of the organic vehicle. Note that various dispersers, plasticizers, dielectrics, insulators and the like may be added into this paste. Incidentally, in the present invention, "parts by mass" is substantially equal to a weight-based value ("parts by weight") (same below)

In manufacturing the green chip in the print method, the paste for the varistor layer and the conductive paste for the inner electrodes are prepared as mentioned earlier, and thereafter, the paste for the varistor layer is applied plurality of times onto a board of polyethylene phthalate or the like to have a predetermined thickness, thus forming the varistor layer 1*c* in a green state. Next, on the varistor layer 1*c* in the green state, the conductive paste for the inner electrodes is applied to have a predetermined pattern, thus forming the inner electrode 2*b* in the green state.

Subsequently, on the inner electrode 2*b* in the green state, the paste for the varistor layer, the conductive paste for the inner electrodes, and the paste for the varistor layer are sequentially applied so that the varistor layer 1*b*, the inner electrode 2*a* and the varistor layer 1*a* are formed, and thereby a stack is obtained. Thereafter, the stack thus obtained is pressurized while being heated so that the layers are attached to each other by pressure, and then cut into a predetermined shape. Thus, the green chip is obtained. It is preferred that the conductive paste for the inner electrodes be applied to have such pattern that one ends of the inner electrodes 2*a* and 2*b* are respectively exposed out from the opposing end faces of the varistor body 1 on different sides.

Meanwhile, in a case of manufacturing the green chip in the latter method, which is the sheet method, first of all, the aforementioned paste for the varistor layer is formed to have a sheet shape, and a predetermined number of these sheets are layered to have a desired thickness, thus forming a green sheet for forming the varistor layer. Next, the aforementioned conductive paste for the inner electrodes is printed to have a predetermined pattern on the green sheet, thereby forming a sheet having the varistor layer and inner electrode in the green state.

Two of these sheets are prepared. Thereafter, these sheets are arranged so that the inner electrodes face to each other, and also are put together so as to sandwich the another green sheet for forming the varistor layer therebetween. Thus, a stack is obtained. Subsequently, the stack is pressurized while being heated so that the layers are attached to each other by pressure and than cut into a predetermined shape. Thus, a green chip is obtained.

In manufacturing the multilayer chip varistor 100, the green chip is formed in the foregoing print method or the sheet method, and thereafter, the green chip is subjected to a debinding. The debinding can be carried out, for example, by raising temperature at a rate of about 5 to 300 degrees centigrade/hour in an atmosphere of air, and then holding a temperature at about 180 to 400 degrees centigrade for 0.5 to 24 hours.

Subsequently, the debinded green chip is baked, and thus the varistor body 1 is obtained. The baking of the green chip can be carried out, for example, by raising temperature at a rate of about 50 to 500 degrees centigrade/hour in an atmosphere of air, holding a temperature at 1000 to 1400 degrees centigrade for about 0.5 to 8 hours, and thereafter cooling down at a rate of about 50 to 500 degrees centigrade/hour.

If the temperature that is held while baking is lower than 1000 degrees centigrade, it is unlikely that the inner electrodes 2*a* and 2*b* and the varistor layers 1*a*, 1*b* and 1*c* are formed sufficiently densely. On the other hand, if the temperature is more than 1400 degrees centigrade, it is likely that the inner electrodes 2*a* and 2*b* are sintered excessively and become fragile.

After the end faces (ends) of the varistor body 1 thus obtained are polished in a barrel or by sandblast, the conductive paste for terminal electrodes is printed or transferred onto the end faces, and then baked by further heating to form the terminal electrodes 3*a*. If the conductive paste for the terminal electrode contains glass frit, it is preferred that the temperature of baking (heating) the conductive paste be at least 70 degrees centigrade higher than the softening point of the glass frit. It is also preferred that a temperature of baking a generally-used conductive paste be 700 degrees centigrade or higher.

For the conductive paste for terminal electrodes, it is possible to use paste that is prepared similarly to the conductive paste for the inner electrodes, except that a conductive material for the terminal electrodes is compounded. For the conductive material for the terminal electrode used herein, a simple substance of Ag, an Ag—Pd alloy and the like are preferred. From the viewpoints of an improvement in adhesion of the terminal electrodes 3*a* to the varistor body 1 and easy formation of the glass layer 4, it is preferred that the conductive paste for the terminal electrodes contain a glass material such as glass frit. In the case where the glass frit is contained in the conductive material for the terminal electrodes, it is preferred that the content of the glass frit be 2 to 15 wt % with respect to the entire mass of the conductive material (metal) and the glass frit.

If the glass frit is contained in the conductive paste for the terminal electrodes, the glass frit melts from the electrode material under a high temperature condition while baking. The glass frit melting from the electrode material is adhered to the end faces of the varistor body 1, thus forming the glass layer 4 between the varistor body 1 and the terminal electrodes 3*a*.

In manufacturing the multilayer chip varistor 100, the glass layer 4 is not necessarily formed by the glass frit melting from the conductive paste and may be formed in separate steps of, for example, applying the glass material on the end faces of the varistor body 1 and then baking the glass material.

After the glass layers 4 and the terminal electrodes 3*a* are formed in the above manner, the plated layers 3*b* made of Ni are formed on the terminal electrodes 3*a*, respectively. The plated layers 3*c* made of solder, Sn or the like are further formed on the plated layer 3*b*. Thus, the multilayer chip varistor 100 is obtained. A preferred plating method for these plated layers is electroplating.

In the multilayer chip varistor 100 manufactured in the foregoing manner, one ends of the inner electrodes 2*a* and 2*b* are protruding into the terminal electrodes 3*a*, and at least root portions of these protruding inner electrode 2*a* and 2*b* are covered with glass layer 4. It is considered that this kind of shape in the multilayer chip varistor 100 is formed as follows.

Specifically, in the preferred case, the inner electrodes 2*a* and 2*b* and the terminal electrodes 3*a* in the multilayer chip varistor 100 respectively contain different kinds of metals such as Ag, Pd and Pt, each having a crystal structure of face-centered cubic lattice. If the inner electrodes 2*a* and 2*b* and the terminal electrodes 3*a* contain these kinds of metals, the metals are diffused through contact interface at a high temperature while baking. This is so-called Kirkendall effect.

Once Kirkendall effect occurs, metal contained in the inner electrodes 2*a* and 2*b* is diffused into the terminal electrodes 3*a* and metal contained in the terminal electrodes 3*a* is diffused into the inner electrodes 2*a* and 2*b*. Due to this diffusion, one ends of the inner electrodes 2*a* and 2*b* protrudes into the terminal electrodes 3*a*.

Accordingly, due to the diffusion of the aforementioned metals, the joint between the inner electrodes 2*a* and 2*b* and the terminal electrodes 3*a* and vicinities thereof become dense. At the same time, the peripheral areas of protruding portions of the inner electrodes 2*a* and 2*b* are covered with the glass layers 4. Consequently, joint performance of the inner electrodes 2*a* and 2*b* and the terminal electrodes 3*a* is improved, and penetration of the varistor body 1 by the plating solution is further reduced during the plating process.

Moreover, voids-are formed between the inner electrodes 2*a* and 2*b* and the varistor layers 1*a*, 1*b* and 1*c* as atoms diffuse. Once Kirkendall effect occurs, these voids are filled with glass which melted when baking the terminal electrodes 3*a*. This tends to make it more difficult for the plating solution to enter inside the varistor body 1.

EXAMPLE

<Manufacturing of Multilayer Chip Varistor>

First of all, $B_2O_3$—ZnO—$Al_2O_3$—SrO based glass was used as the glass frit, Ag was used as conductive powder (metal), ethyl cellulose and terpineol were used for the organic vehicle. The above materials were mixed and then kneaded, so as to yield the conductive paste for forming the terminal electrodes was obtained. At this time, a compounding ratio of the glass frit was set to 1 to 16 wt % with respect to the total weight of the glass frit and Ag powder. Further, amounts of ethyl cellulose and terpineol added into the paste was set to 15 parts by weight and 10 parts by weight, respectively, based on 100 parts by weight of total weight of Ag powder and the glass frit. Thus, the compounding ratio of the glass frit was set to 1 wt % or larger. This is because the compounding ratio smaller than 1 wt % might cause insufficient adhesive force between the terminal electrodes and the varistor body after baking.

Next, the varistor body was formed. The varistor body included the varistor layers whose principal component was ZnO and the inner electrodes which was made of Pd. The aforementioned conductive paste was applied onto the ends of the varistor body thus obtained, and then dried. Thereafter, the paste was baked under a condition of 700 degrees centigrade for 10 minutes in an atmosphere so as to yield terminal electrodes. The terminal electrodes ware formed to have a thickness of 3 μm, 5 μm and 50 μm. The baking temperature (700 degrees centigrade) here is about 20 degrees centigrade higher than the general temperature of backing the terminal electrodes containing the glass frit. In addition, the thickness of the terminal electrode is an average value of the maximum thickness values of the respective terminal electrodes formed on both end faces of the varistor body.

Next, a Ni plated layer and a Sn plated layer were sequentially formed on the terminal electrodes by plating process, and thereby the multilayer chip varistor having a configuration shown in FIG. 1 was obtained. The average thickness of the Ni plated layer was set to 2 μm, and that of the Sn plated layer was set to 5 μm. These values were obtained by calculating the average value of those measured at five points of the thickness using a photograph taken by a scanning electron microscope at 2000 times magnification.

<Evaluation of Characteristics>

Used were the multilayer chip varistors, formed by above mentioned manner, each having different compound ratios of the glass frit in the conductive paste and different thickness of terminal electrode. In each of these multilayer chip varistors, thickness of the glass layer, coverage of the glass layer, a rate of change of a varistor voltage after plating, and characteristics degradation rate after reflow soldering were measured. Table 1 collectively shows results of the compound ratio of grass frit, the thickness of the terminal electrode, and other measurements mentioned above in each of the multilayer chip varistors.

(Measurement of Thickness and Coverage of the Glass Layer)

The thickness of the glass layer was obtained in the following manner. First of all, a cross section of an outer terminal (terminal electrode) of the multilayer chip varistor, taken along a line passing through the center thereof in a width direction (a cross section along the line L in FIG. 2) was observed by the scanning electron microscope. Thereafter, the thickness of the glass layer formed on one end face of the varistor body was measured at five points using a photograph taken by the scanning electron microscope at 2000 times magnification. The average value of those obtained from the measurement was calculated, and thus the thickness of the glass layer was obtained.

The coverage r (%) of the glass layer was obtained in the following manner. Lengths L1 and L2 were measured using a photograph of a cross section as described above, taken by the scanning electron microscope. L1 is the entire length of an area (end face) of the varistor body, covered by the terminal electrode, and L2 is a length of an area (end face) of the varistor body in which the glass layer is formed. Thereafter, the coverage r(%) is calculated using the following equation (1) based on the values of L1 and L2 thus obtained.

$$r(\%) = (L2/L1) \times 100 \quad (1)$$

(Measurement of a Rate of Change of the Varistor Voltage)

In each of the multilayer chip varistors, varistor voltages before and after forming the Ni plated layer and the Sn plated layer were measured. The varistor voltage is a voltage between outer terminals when current of 1 mA is flown therebetween in the multilayer chip varistor. Based on the obtained values of the varistor voltages, a rate of change of the varistor voltages was calculated. Specifically, twenty samples for each type of multilayer chip varistor were made.

Next the varistor voltages of each sample before forming the Ni plated layer and the Sn plated layer were measured, and thereafter each sample was plated and the varistor voltage of the same after plating was measured. The rate of change ΔVm (%) was calculated by dividing a difference between V2 and V1 by V1, as shown in the following equation (2):

$$\Delta Vm(\%) = \{(V2 - V1)/V1\} \times 100 \quad (2)$$

where V1 is an average value of the varistor voltages obtained from each of the samples before plating and V2 is an average value of the varistor voltages obtained after plating.

(Measurement of Characteristics Degradation After Reflow Soldering)

Measured were the varistor voltages before and after reflow soldering of each multilayer chip varistor in which the Ni and Sn plated layers were formed. Based on the obtained valued of the varistor voltages, the characteristics degradation after reflow soldering was calculated. Specifically, twenty samples for each type of multilayer chip varistor having Ni and Sn plated layers were made. Next, the varistor voltage V3 of each sample before reflow soldering is measured, and thereafter, each sample was mounted on a board by reflow soldering and the varistor voltage V4 of each sample after reflow soldering was measured. By using the values of V3 and V4 and following the equation (3) below, the rate of change ΔVr(%) of the varistor voltage obtained from each sample was calculated. Thereafter, the sample with the rate of change of 10% or larger in the varistor voltage was regarded defective, and the number of samples regarded defective was counted out of twenty samples for each type of multilayer chip varistor. In this way, the characteristics degradation after reflow soldering was measured.

$$\Delta Vr(\%) = \{(V4 - V3)/V3\} \times 100 \quad (3)$$

TABLE 1

| No. | Content of Glass Frit (wt %) | Thickness of Glass Layer (μm) | Coverage (%) | Rate of Change of Varistor Voltage Average Value of twenty samples (%) | Characteristics Degradation after Reflow Soldering (Number of defective samples/twenty samples) | Thickness of Terminal electrode (μm) |
|---|---|---|---|---|---|---|
| 1 | 1 | Unable to measure | 5 | −12 | 2/20 | 50 |
| 2 | 1.5 | 0.1 | 8 | −8 | 1/20 | 50 |
| 3 | 2 | 0.1 | 10 | −5 | 0/20 | 50 |
| 4 | 5 | 0.4 | 40 | −2 | 0/20 | 50 |
| 5 | 10 | 0.9 | 80 | −1.5 | 0/20 | 50 |
| 6 | 15 | 1.5 | 100 | −0.5 | 0/20 | 50 |
| 7 | 16 | 1.7 | 100 | Unable to plate | Unable to plate | 50 |
| 8 | 5 | 0.4 | 40 | −11 | 0/20 | 3 |
| 9 | 5 | 0.4 | 40 | −3 | 0/20 | 5 |

As shown in Table 1, in the samples of the multilayer chip varistor No. 1, in which the content of the glass frit in the conductive paste is 1 wt % and the thickness of the terminal electrode is 50 μm, the coverage of the glass layer was 5%. In this multilayer chip varistor, the average rate of change of the varistor voltage was −12% and the number of defective samples was two out of twenty. In addition, it was difficult to measure the thickness of the glass layer in these samples.

In the samples of the multilayer chip varistor No. 2, in which the content of the glass frit was 1.5 wt % and the thickness of the terminal electrode was 50 μm, the thickness of the glass layer was 0.1 μm and the coverage thereof was 8%. As a result, the average rate of change of the varistor voltage became −8%, and the number of defective samples was one out of twenty.

In the samples of multilayer chip varistor No. 3, in which the content of the glass frit was 2 wt % and the thickness of the terminal electrode was 50 μm, the thickness of the glass layer was 0.1 μm and the coverage thereof was 10%. In this multilayer chip varistor, the average rate of change of the varistor voltage became −5%, and the number of defective samples was zero out of twenty.

In the samples of multilayer chip varistors No. 4 to No. 6, in which the content of the glass frit was increased from 5 to 15 wt % and the thickness of the terminal electrode was 50 μm, the thickness of the glass layer was 0.4 μm or larger and the coverage thereof was 40% or larger in all of the multilayer chip varistors. As a result, the average rate of change of the varistor voltage was from −2% to −0.5%, and the number of defective samples was zero out of twenty. In the samples of the multilayer chip varistor No. 7 in which the content of the glass frit was 16 wt %, it was difficult to form the plating layers on the terminal electrode.

From the foregoing, it became evident that, in the multilayer chip varistors, each having the glass layer formed between the varistor body and the terminal electrode, a reduction in varistor voltage was small even when the plated layers were formed on the terminal electrode by plating. It also became evident that the varistor characteristics are sufficiently maintained in these multilayer chip varistors having plated layers even when these varistors were mounted on the board by reflow soldering.

Further, from the foregoing results, it became evident that relatively preferable results were obtained when the content of the glass frit was between 2 and 15 wt %, the thickness of the glass layer was between 0.1 and 1.5 μm, and the coverage thereof was between 10 to 100%. In addition, it became evident that degradation of the varistor characteristics due to plating could be prevented most remarkably when the content of the glass frit was between 5 and 10%, the thickness of the glass layer was between 0.4 and 0.9 μm, and the coverage thereof was between 40 and 80%.

As set forth in the foregoing, according to the present invention, the glass layer 4 is formed between the varistor body 1 and the terminal electrodes 3*a*. Thus, it becomes possible to provide the multilayer chip varistor 100 in which degradation of the varistor characteristics due to entry of the plating solution into the varistor body 1 is extremely small, even though the plating solution penetrates through the terminal electrode 3*a* while plating.

Additionally, the glass layer 4 is formed by the glass frit which melts from the electrode material while forming the terminal electrode 3*a*. Thus, it is not required to carry out a separate step for forming the glass layer 4, thereby making it easier to manufacture the multilayer chip varistor that is excellent in resistance to the plating solution.

Further, since the multilayer chip varistor 100 has the aforementioned characteristics, degradation of the varistor characteristics due to heat history owing to reflow soldering is small even though the multilayer chip varistor 100 is mounted on the board by reflow soldering. Therefore, the multilayer chip varistor 100 is highly-reliable.

The basic Japanese Application No. 2002-365269 filed on Dec. 17, 2002 is hereby incorporated by reference.

What is claimed is:

1. A multilayer chip varistor, comprising:

a varistor body including a plurality of varistor layers and inner electrodes arranged to sandwich each of the varistor layers;

terminal electrodes formed on ends of the varistor body and connected to the inner electrodes; and a glass layer formed between the varistor body and the terminal electrode, wherein, the terminal electrode contains silver or an alloy whose principal component is silver which has a crystal structure of face-centered cubic lattice, and the inner electrodes contain palladium, platinum or an alloy whose principal component is palladium or platinum which has a crystal structure of face-centered cubic lattice; and wherein, the terminal electrode further contains a glass material.

2. The multilayer chip varistor according to claim 1, wherein, in a cross section taken along a line passing through a center of the terminal electrode in a width direction thereof, each of the glass layers is formed to cover not less than 10% of a total length of an area which is covered with the terminal electrode, in the varistor body.

3. The multilayer chip varistor according to claim 1, wherein each of the glass layers has a thickness of 0.1 μm or larger.

4. The multilayer chip varistor according to claim 1, wherein the terminal electrodes are formed by baking conductive paste containing a glass material, and the glass layers are formed by the glass material melting from the conductive paste while baking the conductive paste.

5. The multilayer chip varistor according to claim 4, wherein the conductive paste contains metal and the glass material, and a content of the glass material is between 2 and 15 wt % with respect to an entire mass of the metal and the glass material.

6. The multilayer chip varistor according to claim 1, wherein the inner electrodes protrude from the varistor body into the terminal electrodes, and at least root portions of the inner electrodes protruding into the terminal electrodes are covered with the glass layer.

* * * * *